United States Patent [19]

Moriya

[11] 4,287,995

[45] Sep. 8, 1981

[54] CONTAINER SEALING MEMBER WITH OXYGEN ABSORBENT

[75] Inventor: Takehiko Moriya, Tokyo, Japan

[73] Assignee: Mitsubishi Gas Chemical Company, Inc., Tokyo, Japan

[21] Appl. No.: 97,425

[22] Filed: Nov. 26, 1979

[30] Foreign Application Priority Data

| | | | |
|---|---|---|---|
| Nov. 30, 1978 | [JP] | Japan | 53-165451 |
| Nov. 30, 1978 | [JP] | Japan | 53-165452 |
| Dec. 4, 1978 | [JP] | Japan | 53-166842 |
| Feb. 14, 1979 | [JP] | Japan | 54-17628 |
| Mar. 6, 1979 | [JP] | Japan | 54-28218 |
| Mar. 6, 1979 | [JP] | Japan | 54-28219 |
| Mar. 6, 1979 | [JP] | Japan | 54-28220 |
| Mar. 13, 1979 | [JP] | Japan | 54-32218 |

[51] Int. Cl.[3] ..... B65D 85/72

[52] U.S. Cl. ..... 215/228; 426/124

[58] Field of Search ..... 215/228, 231; 206/205; 426/124, 118

[56] References Cited

U.S. PATENT DOCUMENTS

| | | | |
|---|---|---|---|
| 1,584,903 | 5/1926 | Supplee | 426/124 |
| 2,915,404 | 12/1959 | Tessmer | 215/228 X |
| 3,254,784 | 6/1966 | Lancesseur | 215/228 |
| 3,255,020 | 6/1966 | Ferrell | 426/124 |
| 3,712,848 | 1/1973 | Casey | 426/118 X |
| 4,192,773 | 3/1980 | Yoshikawa | 206/205 X |

*Primary Examiner*—Donald F. Norton

*Attorney, Agent, or Firm*—Browdy and Neimark

[57] ABSTRACT

A container sealing member for a container used for preserving an aqueous liquid or semi-liquid material is disclosed. Said sealing member is characterized in that some of the space inside the sealing member is filled with an oxygen absorbent and the absorbent is separated from the contents of the container by a film which adheres to the sealing member so as to prevent the oxygen absorbent from contacting the contents of the container, the film having a plurality of fine openings and being gas-permeable but water-impermeable at one atmospheric pressure.

6 Claims, 28 Drawing Figures

CONTAINER SEALING MEMBER WITH OXYGEN ABSORBENT

BACKGROUND OF THE INVENTION

This relates to a container sealing member for a container used for preserving an aqueous liquid or semi-liquid material, and particularly relates to a container sealing member which, when placed on, fitted over or inserted in a container for preserving an aqueous liquid or semi-liquid material, is capable of absorbing oxygen present in the container.

In order to preserve foodstuffs, such as soy sauce, Japanese sake, sauce, wine, beer, juice, vinegar, etc., it is necessary to prevent the foodstuffs from getting moldy and from putrefying. In the prior art methods, the gas present in the inner part of a content-charged container was replaced by an inert gas or the container was sterilized. However, replacement of oxygen by an inert gas requires large-scale apparatus and sterilization of the filled container may cause change in quality of the contents. Additives, such as antioxidants, have been used for preserving foodstuffs. However, recently, governments have started to regulate the use of additives for foods, since some additives have been found to be injurious to humans.

Molds or eumycetes, bacterias and higher organisms such as insects tend to disturb preservation of foodstuffs. These mold eumycetes, bacterias and insects live and grow in the presence of oxygen and cause putrefaction and change in quality of foodstuffs.

Therefore, if oxygen can be selectively removed from the empty space of the filled container, the problems of putrefaction and change in quality of foodstuffs can be overcome, and it will become possible to preserve foodstuffs for extended periods.

SUMMARY OF THE INVENTION

One object of this invention is to provide a container sealing member capable of absorbing oxygen present in the filled container.

Another object of this invention is to provide a container sealing member, characterized in that some of the space inside the sealing member is filled with an oxygen absorbent which is kept separate from the contents of the container by a gas-permeable film.

This invention relates to a container sealing member for a container used for preserving an aqueous liquid or semi-liquid material, characterized in that some of the space inside the sealing member is filled with an oxygen absorbent, and the absorbent is separated from the contents of the container by a film which adheres to the sealing member so as to prevent the oxygen absorbent from contacting of the contents of the container, the film having a plurality of fine openings, and being gas-permeable, but water-impermeable at one atmosphere of pressure.

BRIEF EXPLANATION OF THE INVENTION

Figure 14:
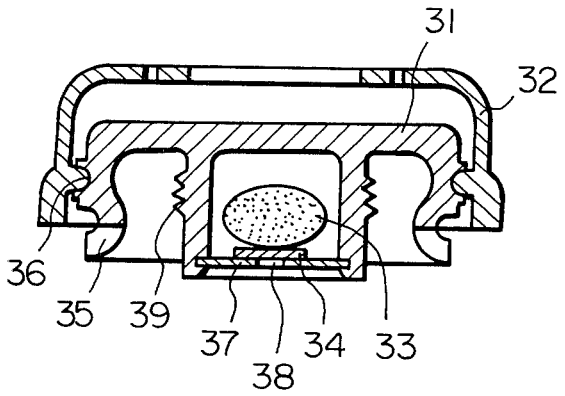
Figure 15:
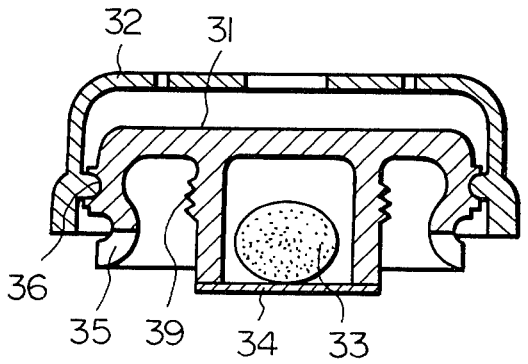
Figure 16:
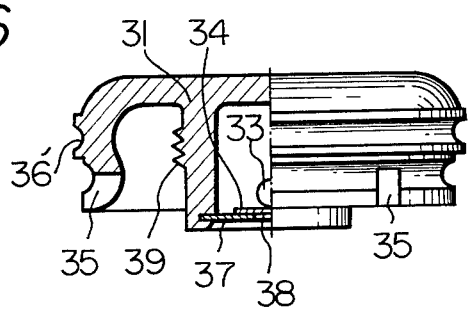
Figure 17:
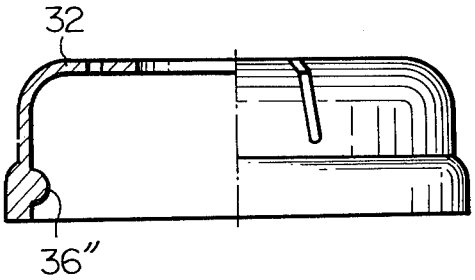
Figure 18:
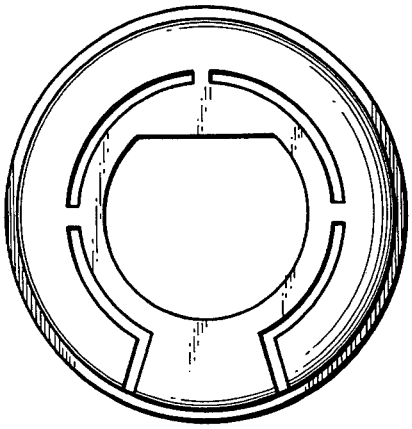
Figure 19:
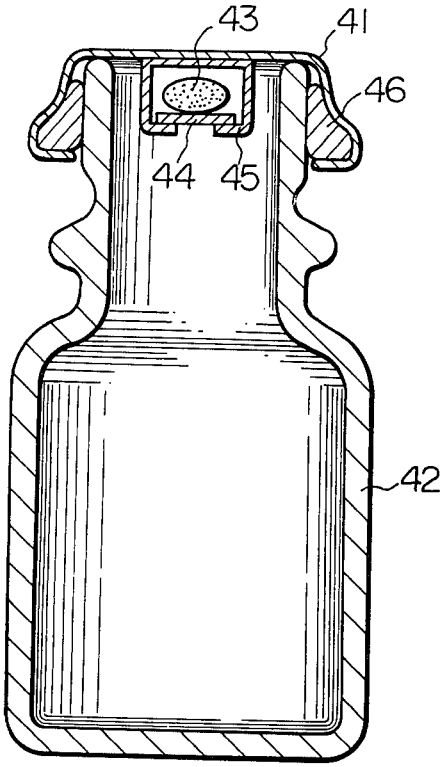
Figure 20:
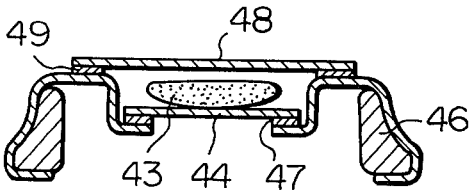
Figure 21:
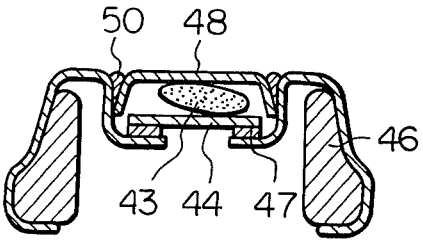
Figure 22:
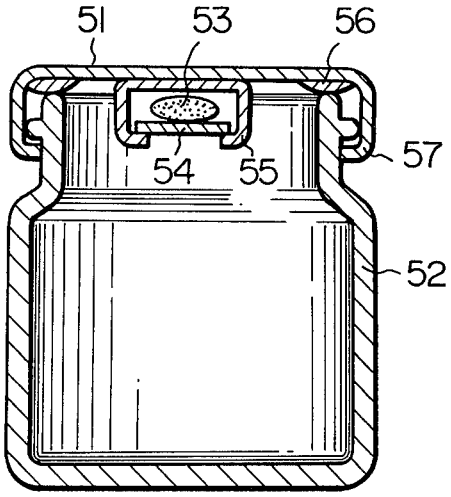
Figure 23:
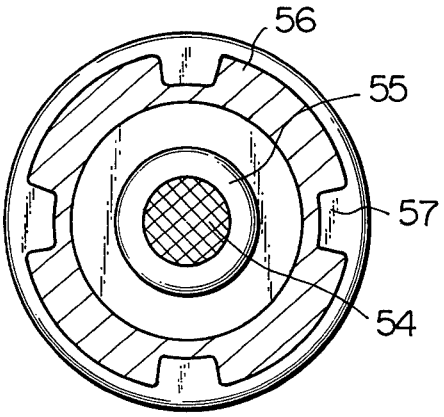
Figure 24:
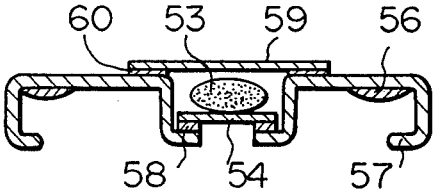
Figure 25:
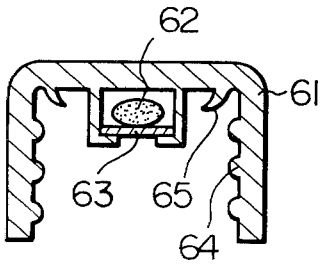
Figure 26:
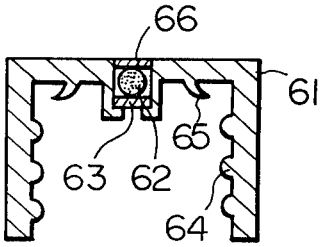
Figure 27:
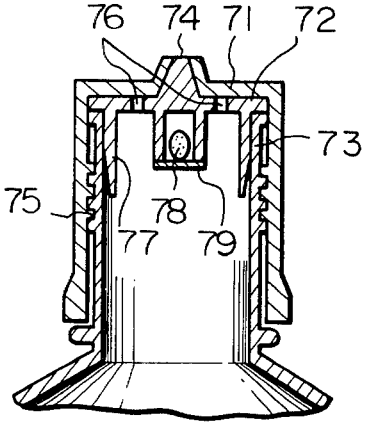
Figure 28:
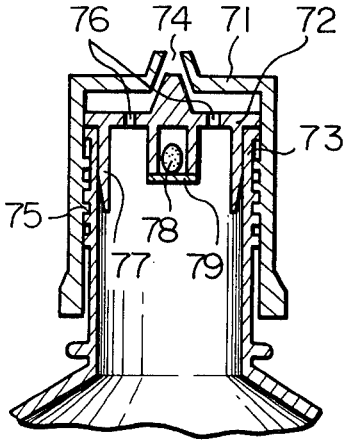

FIGS. 14-18 show the fourth embodiment of this invention, and FIGS. 14 and 15 are a fragmentary sectional view each of different sealing members and clamps; left half portion of FIG. 16 is fragmentary sectional view of the sealing member shown in FIG. 14 and right half portion of FIG. 16 is a side view thereof; left half portion of FIG. 17 is a fragmentary sectional view of the clamp shown in FIG. 15 and right half portion of FIG. 17 is a side view thereof; and FIG. 18 is a plan view of the clamp shown in FIG. 14;

FIGS. 19-21 show the fifth embodiment of this invention, and FIG. 19 is a fragmentary sectional view of container and sealing member fitted thereover, FIGS. 20 and 21 are a fragmentary sectional view each of different sealing members;

FIGS. 22-24 show the sixth embodiment of this invention, and FIG. 22 is a fragmentary sectional view of contained and sealing member placed thereon; and FIG. 23 is a plan view of the sealing member shown in FIG. 22 and FIG. 24 is fragmentary sectional view of another sealing member;

FIGS. 25 and 26 show the seventh embodiment of this invention, are a fragmentary sectional view each of different sealing members; and FIGS. 27 and 28 show the eighth embodiment of this invention, and are a fragmentary sectional view each of different sealing members and covering caps.

DETAILED EXPLANATION OF THE INVENTION

The term "oxygen absorbent" in the specification and the claims means an agent for absorbing or removing oxygen present in the atmosphere of the container. Examples of the oxygen absorbents employed in the practice of this invention are disclosed in U.S. Pat. No. 4,113,652 by Yoshikawa et al patented on Sept. 12, 1978; U.S. Pat. No. 4,104,192 by Yoshikawa et al patented on Aug. 1, 1978; U.S. Pat. No. 4,199,472 by Ohtsuka et al; U.S. Pat. No. 4,127,503 patented on Nov. 28, 1978; U.S. Pat. No. 4,166,807 by Komatsu et al; and U.S. Pat. No. 4,192,773 by Yoshikawa et al which are incorporated herein. Examples of the oxygen absorbents include reducing agents, such as iron powder, oxalates, sulfites, hydrogen sulfites, dithionites, pyrogallol, Rongalit, glucose, copper amine complex, zinc powder and the like, and any compositions containing the reducing agent. A solid oxygen absorbent or a solid carrier impregnated with a liquid oxygen absorbent can be used as the oxygen absorbent of this invention.

The sealing member of this invention includes cap assembly placed on or fitted over a container, and stopper assembly inserted in a container.

The film (sometimes hereinunder referred to as gas permeable film) having a plurality of fine openings or holes and being gas-permeable, but water-impermeable at one atmosphere pressure is well known. The size of the openings is conveniently in the range of 0.01-45 microns. The film having a plurality of elongated openings each having a distance of less than 2 microns across the short axis is preferable. Materials constituting the film include plastics, such as polyethylene, polypropylene, poly (fluorinated ethylene) and the like. The gas-permeable film employed in the practice of this invention may be prepared by cold orientation of untreated film; orientation of different substance-containing film;

extraction of different substance from different substance-containing film; extracting different substance-containing film, followed by orientating the so-treated film; and irradiating untreated film with electron beam. Suitable gas permeable films are commercially available, and are sold under the names Celgard (Celanese Corp.), FP-2 (Asahi Chemical Industry), NOP (Nippon Oil Chemical Co., Ltd.), Nitto Flon (NTF) (Nitto Electrical Industrial Co., Ltd.) and Cellpore NW01 (Sekisui Chemical Co., Ltd.).

The oxygen absorbent is retained on or in the container sealing member by some type of retainer means which, in a simple case, may comprise the gas-permeable film.

The structure of the cap or stopper assembly in which the oxygen absorbent is provided is not critical. Examples of the cap assembly or stopper assembly are explained in the following by referring to the drawings.

FIGS. 1 to 4 show one general type of embodiment. The essential elements are: cap 1; threaded portion 1'; gas permeable film 2; oxygen absorbent 3; elastic packing member 4; and adhering material 5. Cap 1 may be made of a metallic material, such as aluminum, iron and the like or a plastic material, such as polyvinyl chloride, polystyrene, polycarbonate and the like. Elastic packing member 4 serves to seal the mouth of the container and may be made of cork plate, foamed polystyrene sheet, synthetic rubber sheet and the like. The adhering material serves to adhere the gas permeable film to the elastic packing member. The adhering material may be a plastic sheet, such as polyethylene, polypropylene and the like. In this case, gas permeable film, elastic packing member and adhering material are integrated by heat sealing. Or the gas permeable film may be adhered to the elastic packing member with a conventional adhesive.

Figure 1:
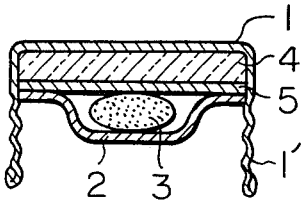
FIGS. 1-4 show the first embodiment of this invention and are a fragmentary sectional view each of different sealing members.
Figure 2:
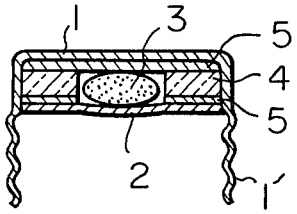
Figure 3:
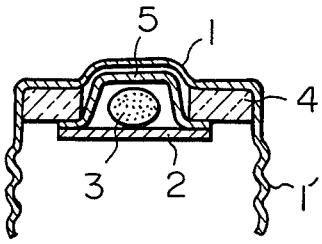
Figure 4:
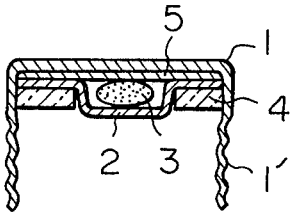
Figure 5:
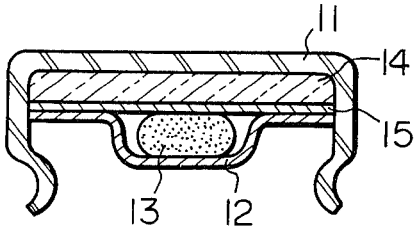
FIGS. 5-8 show the second embodiment of this invention and are a fragmentary sectional view each of different sealing members.
Figure 6:
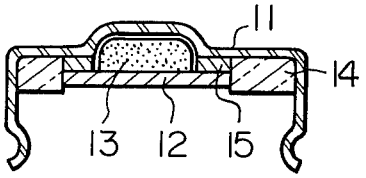
Figure 7:
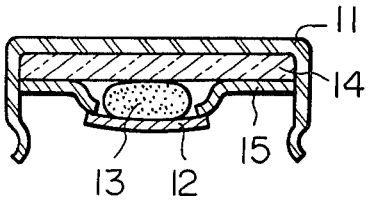
Figure 8:
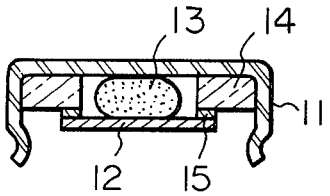
Figure 9:
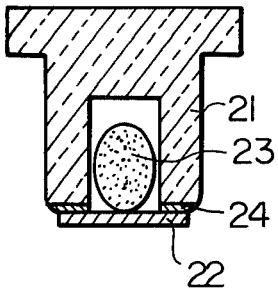
FIGS. 9-13 show the third embodiment of this invention and are a fragmentary sectional view each of different sealing members.

In FIGS. 1, 3, and 4, the retainer means for the oxygen absorbent 3 constitutes the adhering layer 5 together with the gas-permeable film 2. In FIG. 2, the retaining means also includes the interior edge of the elastic packing member 4 which defines a cavity.

FIGS. 5–8 show a second general type embodiment. The essential elements are: crown cap 11, gas permeable film 12, oxygen absorbent 13, elastic packing member 14, and adhering material 15. The respective parts of the cap assembly of the second embodiment are made of the same material as their counterparts in the cap assembly of the first embodiment.

Figure 10:
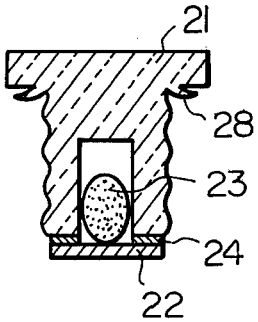
Figure 11:
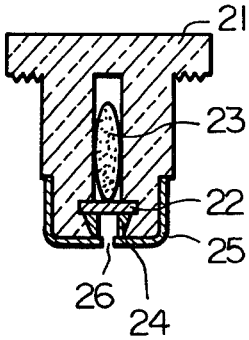
Figure 12:
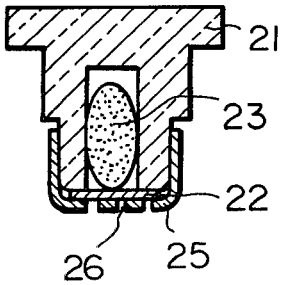
Figure 13:
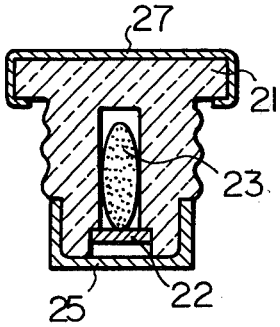

FIGS. 9–13 show a third general type embodiment comprised of the following elements: stopper 21 made of polyethylene, polypropylene or the like, gas permeable film 22, oxygen absorbent 23, and adhering material 24, which serves to adhere stopper 21 to gas permeable film 22. When a plastic sheet, such as polyethylene, polypropylene or the like is used as the adhering material, the stopper, gas permeable film and adhering material may be integrated by heat seal, but the stopper may be adhered to the gas permeable film with a conventional adhesive 24. When the stopper is adhered directly to the gas permeable film by heat seal, adhering material is not used. In FIGS. 11–13, aluminum sheet 25 serves to avoid direct contact of the container contents with the stopper. The aluminum sheet may be only aluminum foil or a laminate of aluminum foil and a plastic film. Lacquer may be coated on the aluminum foil to prevent etching of the aluminum foil. In FIGS. 11–12, holes 26 are made in the aluminum sheet 25 through which oxygen in the container passes to be absorbed by oxygen absorbent 23. The holes may be made either before or after the aluminum sheet 25 is placed on stopper 21. FIG. 13 shows the cap assembly before holes 26 have been made in aluminum sheet 25. Decorative cover composed of metal is shown at 27. Annular elastic flange 28 may be provided around the stopper, as shown in FIG. 10, to insure complete sealing of the container.

FIGS. 14–18 show a fourth general type embodiment. In this embodiment, after cap 31 is inserted into the mouth of the container, clamp 32 is fastened on cap 31 by fastening portion 36. Other elements are: oxygen absorbent 33, gas permeable film 34, depression 35, insert sheet 37 with hole 38 therein and sealing portion 39. Any annular convex portion 36" is provided on clamp 32 and annular concave portion 36' is provided in cap 31. The material of each part constituting the cap assembly of the fourth embodiment is as explained in the first embodiment.

FIGS. 19–21 show a fifth general type embodiment comprising: container 42 having a neck and mouth over which is placed cap assembly 41, retainer element 45 holding oxygen absorbent 43, gas permeable film 44 and gasket 46. When the container mouth is inserted in cap assembly 41, gasket 46 contacts the outer surface of the mouth. FIGS. 20 and 21 show cover 48 for the cap assembly, adhesive at 47 and 49, and sealing agent at 50.

FIGS. 22–24 show a sixth general type embodiment. Oxygen absorbent 53 is placed in retainer 55 of cap assembly 51. Oxygen absorbent 53 is supported by gas permeable film 54. Cap assembly 51 is installed on the mouth of container 52 by fastening portion. Container 52 is sealed by compound 56 of cap assembly 51. Cap assembly 51 may be threaded on the mouth of container 52. In FIG. 24, adhesive is shown at 58 and 60 and cover for cap assembly is shown at 59.

FIGS. 25 and 26 shown a seventh general type embodiment with cap assembly 61 and oxygen absorbent 62 is in the space with cap assembly 61. Oxygen absorbent 62 is separated from contents (not shown) of the container by gas permeable film 63 which adheres to cap assembly 61 by adhesive or heat seal. Other elements are: threaded portion 64; annular flange 65, which serves as a packing to seal the container; and cover 66.

FIGS. 27 and 28 show an eighth general type embodiment comprised of the following elements: stopper assembly 72 which is inserted in container mouth 73; covering cap 71 which is put over stopper assembly 72; exit 74; threaded portion 75; exit 76; threaded portion 77; oxygen absorbent 78; and gas permeable film 79. The inner surface of the covering cap contacts the outer surface of the stopper assembly when the covering cap is tightened to close exits 74 and 76. When the covering cap is loosened, exits 74 and 76 are opened, whereby the contents of the container can be discharged.

In all the embodiments the material of the cap, cover and covering cap may be a metal, such as iron, aluminum and the like, or a plastic, such as polyethylene, polypropylene, polyvinyl chloride, poly (fluorinated ethylene) and the like. The gas permeable film may be adhered to the cap assembly or stopper assembly by means of heat sealing or an adhesive, whereby the oxygen absorbent is completely prevented from contact with the liquid or semi-liquid contents of the container and contamination of the contents can be eliminated. The gas permeable film may be pressed into the cap or stopper assembly instead of adhering the film to the assembly. When the cap assembly or stopper assembly of the present invention is placed on, fitted over or inserted in a container, oxygen present in the container is absorbed into the oxygen absorbent without contaminating the contents of the container, whereby putrefaction or change in quality of the contents can be prevented.

The sealing member of this invention can also be used for preserving an aqueous liquid or semi-liquid materials other than foodstuffs.

The advantage of this invention is further illustrated by the following Examples. However, this invention should not be limited by these examples. The percent and parts in the examples are based on weight unless otherwise specified.

EXAMPLE 1

A number of 500 ml bottles were charged with 440 ml of Japanese sake (special grade) leaving a space of 60 cc. Air was present in the space. One half of the bottles were covered with the present cap assembly as explained in the first embodiment and the other half with prior art cap assembly not having any oxygen absorbent. The oxygen absorbent present in the cap assembly comprises 100 parts of iron powder, 0.4 parts of NaCl and 1 part of activated carbon. The bottles were maintained at 40° C. An organoleptic taste test was carried out.

The taste was evaluated by the following five ratings:

| Ratings | | | | |
|---|---|---|---|---|
| 5 | 4 | 3 | 2 | 1 |
| good taste | ⟷ | bad taste | | spoiled |

The results are shown in Table 1.

TABLE 1

| | | Number of Months after covering with cap assembly (%) | | | | | |
|---|---|---|---|---|---|---|---|
| | | initial | 1 | 2 | 3 | 6 | 9 |
| Cap assembly of this invention | change in concentration of oxygen in the bottle with time (%) | 18.3 | less than 0.1 | less than 0.1 | less than 0.1 | less than 0.1 | less than 0.1 |
| | taste test | 5 | 5 | 5 | 5 | 5 | 5 |
| Cap assembly of prior art | change in concentration of oxygen in the bottle with time (%) | 18.4 | 18.2 | 17.6 | 17.3 | 16.2 | 15.5 |

TABLE 1-continued

| | | Number of Months after covering with cap assembly (%) | | | | | |
|---|---|---|---|---|---|---|---|
| | | initial | 1 | 2 | 3 | 6 | 9 |
| | taste test | 5 | 5 | 5 | 4 | 3 | 2 |

EXAMPLE 2

A number of 1.8 l bottles were charged with 1730 ml of soy sauce leaving a space of 70 cc. Air was present in the space. One half of the bottles were covered with the cap assembly as explained in the second embodiment of this invention and the other half with the prior art crown cap assembly not having any oxygen absorbent. The oxygen absorbent present in the cap assembly was the same as that used in Example 1. The bottles were maintained at 40° C. The growing of mold was observed in the conventionally capped bottles.

The results are shown in Table 2.

TABLE 2

| | | Number of days after covering with cap assembly (%) | | | | | |
|---|---|---|---|---|---|---|---|
| | | initial | 1 | 2 | 3 | 7 | 14 |
| Cap assembly of this invention | change in concentration of oxygen in the bottle with time (%) | 20.9 | 4 | less than 0.1 | | | |
| | thickness of mold | no mold | | | | | |
| Cap assembly of prior art | change in concentration of oxygen in the bottle with time (%) | 20.9 | 20.3 | 19.8 | 19.3 | 18.6 | 18.4 |
| | thickness of mold | no mold | | | 0.5* mm | 2 mm* | 5 mm* |

*Thickness of mold present on the surface of soy sauce

EXAMPLE 3

A number of 1.8 l bottles were charged with 1730 ml of soy sauce leaving a space of 70 cc. Air was present in the space. One half of the bottles were covered with the crown stopper assembly as explained in the third embodiment of this invention and the other half with the prior art crown stopper assembly not having any oxygen absorbent. The oxygen absorbent present in the stopper assembly was the same as that employed in Example 1. The bottles were maintained at 40° C. The growing of mold was observed in the conventionally stoppered bottles.

The results are shown in Table 3.

TABLE 3

| | | Number of days after covering with stopper assembly | | | | | | |
|---|---|---|---|---|---|---|---|---|
| | | initial | 1 | 2 | 3 | 7 | 14 | 30 |
| Cap assembly of this invention | change in concentration of oxygen in the bottle with time (%) | 21 | 2 | less than 0.1 | | | | |
| | thickness of mold | no mold | | | | | | |
| Cap assembly of prior art | change in concentration of oxygen in the bottle with | 21 | 20.7 | 20.5 | 20.3 | 20 | 19.7 | 19.3 |

TABLE 3-continued

| | Number of days after covering with stopper assembly | | | | | | |
|---|---|---|---|---|---|---|---|
| | initial | 1 | 2 | 3 | 7 | 14 | 30 |
| time (%) | | | | | | | |
| thickness of mold | | no mold | | slight mold | * 2mm | * 6mm | * 8mm |

*Thickness of mold present on the surface of soy sauce.

What is claimed is:

1. A container sealing member for a container used for preserving an aqueous liquid or semi-liquid material, characterized in that the sealing member is provided with an oxygen absorbent and retainer means to hold said oxygen absorbent, and the absorbent is covered by a film which adheres to the sealing member so that when the sealing member is in use on a container the oxygen absorbent is prevented from contacting of the contents of the container, the film having a plurality of fine openings, and being gas-permeable, but water-impermeable at one atmospheric pressure and wherein the film has a plurality of fine openings in the range of from 0.01 to 45 microns.

2. The container sealing member as defined in claim 1 wherein the film has a plurality of elongated openings each having a distance of less than 2 microns across the short axis.

3. The container sealing member as defined in claim 1 wherein said retainer means comprises said film which adheres to the sealing member.

4. The container sealing member as defined in claim 1 wherein said retainer means comprises an open cavity in the sealing member, and the oxygen absorbent is retained in the cavity, and the opening of the cavity is shut by the film.

5. The container sealing member as defined in claim 1 wherein the oxygen absorbent contains an iron powder as a reducing agent.

6. A closed container comprising a container and the container sealing member as defined in claim 1 wherein the sealing member is used in said container for preserving an aqueous liquid or semi-liquid foodstuff.

* * * * *